US010704325B2

(12) United States Patent
Georgeault et al.

(10) Patent No.: US 10,704,325 B2
(45) Date of Patent: Jul. 7, 2020

(54) VERSATILE GEAR MOTOR FOR ROLLER BLINDS AND NON-ROLLER BLINDS

(71) Applicant: SOMFY ACTIVITES SA, Cluses (FR)

(72) Inventors: Ronan Georgeault, Cluses (FR); Stephane Thumerel, La Roche sur Foron (FR); Frederic Volle, Ville-la-Grand (FR)

(73) Assignee: SOMFY ACTIVITES SA, Cluses (FR)

( * ) Notice: Subject to any disclaimer, the term of this patent is extended or adjusted under 35 U.S.C. 154(b) by 246 days.

(21) Appl. No.: 15/744,175

(22) PCT Filed: Jul. 25, 2016

(86) PCT No.: PCT/EP2016/067617
§ 371 (c)(1),
(2) Date: Jan. 12, 2018

(87) PCT Pub. No.: WO2017/017047
PCT Pub. Date: Feb. 2, 2017

(65) Prior Publication Data

US 2018/0202226 A1 Jul. 19, 2018

(30) Foreign Application Priority Data

Jul. 24, 2015 (FR) ..... 15 57098

(51) Int. Cl.
*E06B 9/70* (2006.01)
*E06B 9/72* (2006.01)
(Continued)

(52) U.S. Cl.
CPC ..... *E06B 9/70* (2013.01); *E06B 9/32* (2013.01); *E06B 9/322* (2013.01); *E06B 9/72* (2013.01); *E06B 2009/725* (2013.01)

(58) Field of Classification Search
CPC ..... E06B 2009/725
(Continued)

(56) References Cited

U.S. PATENT DOCUMENTS 4,170,276 A 10/1979 Hashimoto et al.
5,044,417 A * 9/1991 Bresson ..... E06B 9/72 160/310

(Continued)

FOREIGN PATENT DOCUMENTS

CN 101815841 8/2010
CN 202718602 2/2013

(Continued)

OTHER PUBLICATIONS

International Search Report, dated Oct. 19, 2016, from corresponding PCT/EP2016/067617 application.

(Continued)

*Primary Examiner* — Kyle R Grabowski
(74) *Attorney, Agent, or Firm* — Young & Thompson

(57) ABSTRACT

Disclosed is a motor assembly for a motor unit for driving a shaft for rolling a blind, the assembly including a rotary motor and an output shaft connected to the rotary motor in order to transmit the torque supplied by the rotary motor to the rolling shaft, the output shaft including a first socket for receiving a drive member of the rolling shaft of a roller blind. The output shaft also includes a second socket, separate from the first socket, for securing a non-roller blind to the rolling shaft.

22 Claims, 7 Drawing Sheets

(51) Int. Cl.
*E06B 9/32* (2006.01)
*E06B 9/322* (2006.01)

(58) Field of Classification Search
USPC ..... 160/310, 311
See application file for complete search history.

(56) References Cited

U.S. PATENT DOCUMENTS

| | | | | |
|---|---|---|---|---|
| 5,105,871 | A | 4/1992 | Baud et al. | |
| 5,228,491 | A | 7/1993 | Rude et al. | |
| 5,725,040 | A | 3/1998 | Domel | |
| 7,281,562 | B2 * | 10/2007 | Huang | E06B 9/322 160/168.1 P |
| 2005/0035238 | A1 * | 2/2005 | Fun | E06B 9/72 242/381 |
| 2006/0232234 | A1 * | 10/2006 | Newman, Jr. | E06B 9/72 160/310 |
| 2008/0257504 | A1 * | 10/2008 | Marchetto | E06B 9/88 160/311 |
| 2009/0176615 | A1 * | 7/2009 | Gasparrini | E06B 9/68 475/331 |
| 2014/0000819 | A1 * | 1/2014 | Mullet | E06B 9/60 160/311 |

FOREIGN PATENT DOCUMENTS

| | | | | |
|---|---|---|---|---|
| CN | 202850834 | | 4/2013 | |
| CN | 204238780 | | 4/2015 | |
| DE | 1509195 | | 12/1968 | |
| DE | 20 2011 105060 | U1 | 10/2011 | |
| EP | 0479719 | | 4/1992 | |
| EP | 0730080 | | 9/1996 | |
| EP | 0976909 | A2 * | 2/2000 | E06B 9/68 |
| EP | 0960252 | | 1/2006 | |
| EP | 2 314 824 | A1 | 4/2011 | |
| EP | 2369125 | A2 * | 9/2011 | E06B 9/72 |
| EP | 2886785 | B1 * | 9/2016 | E06B 9/88 |
| FR | 2339276 | | 8/1977 | |
| GB | 1192757 | A * | 5/1970 | E06B 9/88 |
| WO | 2014-152427 | | 9/2014 | |

OTHER PUBLICATIONS

French Search Report for Application No. 1557098, dated Jun. 6, 2016.

* cited by examiner

VERSATILE GEAR MOTOR FOR ROLLER BLINDS AND NON-ROLLER BLINDS

BACKGROUND OF THE INVENTION

The present invention relates to a motor assembly for a motor unit for driving a shaft for rolling a blind, the assembly comprising:

a) a rotary motor; and b) an output shaft connected to said rotary motor in order to transmit the torque supplied by the rotary motor to said rolling shaft, the output shaft comprising a first socket for receiving a drive member of the rolling shaft of a roller blind.

Such an assembly is known from document EP 2,314,824 A1.

Yet this known assembly and the associated tubular motor are used exclusively to motorized roller blinds. They are therefore of limited usefulness.

Consequently, one aim of the invention is to produce a versatile motor assembly. It in particular involves obtaining a motor assembly that can be used indifferently to motorize several types of blinds.

SUMMARY OF THE INVENTION

According to the invention, this aim is achieved with an assembly as defined above, characterized in that the output shaft further includes a second socket, separate from the first socket, for securing a non-roller blind to the rolling shaft.

By providing a second socket on the output shaft, the motor assembly can serve not only to drive a roller blind, but also to drive a non-roller blind, without it being necessary to adapt said assembly.

In particular embodiments of the invention, the motor assembly comprises one, several or all of the following, according to all technically possible combinations:

- the second socket is arranged in the end of the output shaft separated from the rotary motor;
- the second socket comprises a cavity, preferably with a polygonal section, and in particular a rectangular section, for receiving an end of the rolling shaft of a non-roller blind;
- the axis of the cavity is combined with the rotation axis of the output shaft;
- the cavity is a first segment of a hole, the hole comprising, from the outside toward the inside, this first segment followed by a second segment, preferably frustoconical, the second segment being narrower than the first segment;
- the first socket comprises several, preferably four, axial edges on which the drive member can be supported and immobilized in the axial direction, in particular by snapping;
- a transmission, and in particular a reducing gear, to react and adapt the torque delivered by the rotary motor, said transmission being connected by one end to said rotary motor and by the other end to said output shaft;
- a coupling inserted between the rotary motor and the transmission and ensuring the proper torque take-up between the rotary motor and the transmission;
- the coupling includes at least one indentation able to receive a positioning element for a casing accommodating the motor assembly;
- the coupling includes a first ring on the motor side and a second ring on the transmission side that are axially offset relative to one another and preferably connected to one another by two bridges;
- the two rings delimit the or each indentation between them; and
- the second ring is provided with at least one stud for fastening the coupling to the transmission.

The invention also relates to a motor unit comprising a casing accommodating a motor assembly as defined above as well as a control unit for the motor assembly.

Preferably, the motor unit is a tubular actuator for a roller blind or an actuator for a non-roller blind.

BRIEF DESCRIPTION OF THE DRAWINGS

One preferred embodiment of the invention will now be described in detail, in reference to the appended drawings, in which.

DETAILED DESCRIPTION OF THE PREFERRED EMBODIMENTS

Figure 1:
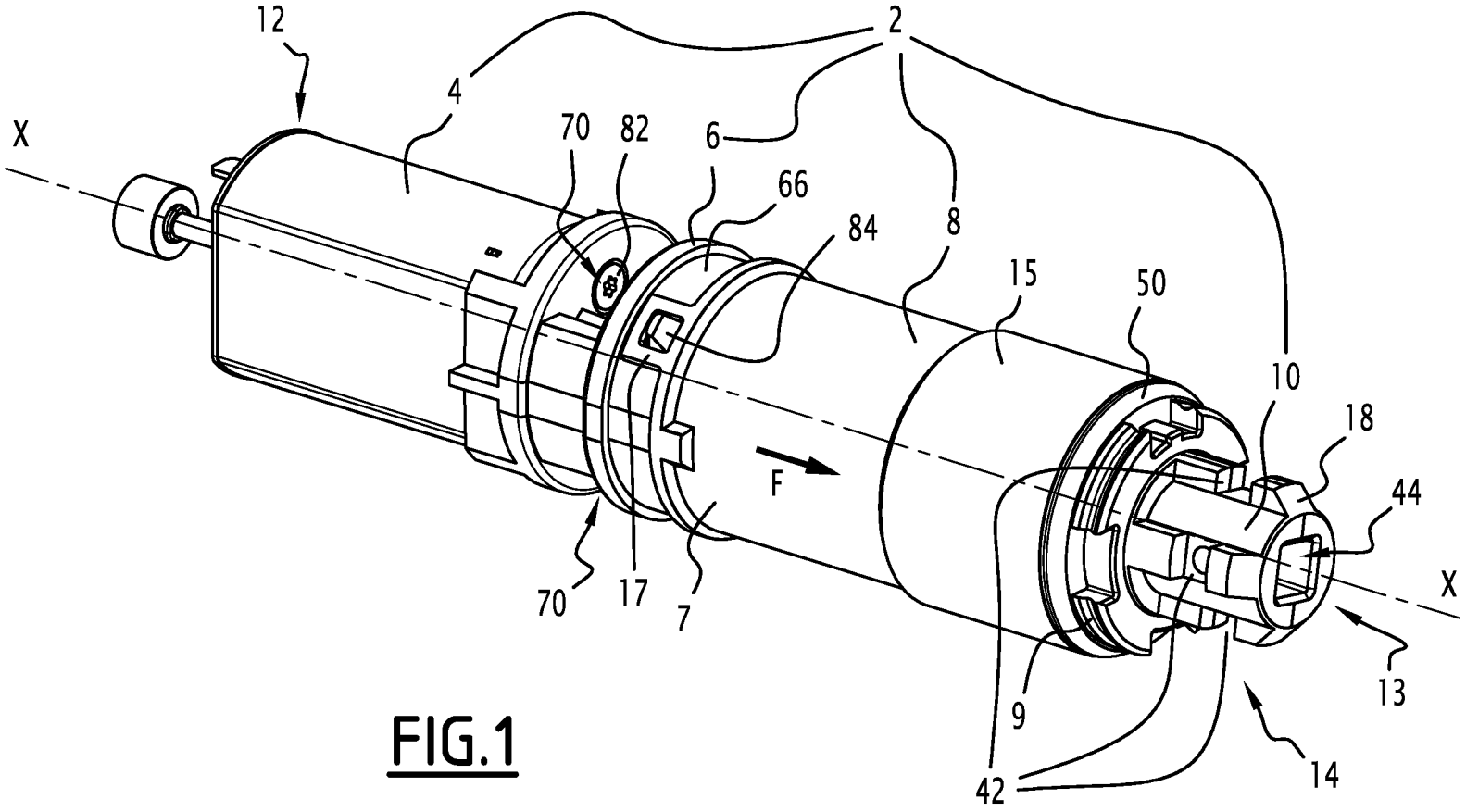
FIG. 1 is a perspective view of a motor assembly according to the invention.

FIG. 1 shows a motor assembly 2. Such a motor assembly 2 is used to motorize window blinds, in particular indoor window blinds. Owing to the motor assembly 2, the blind can be raised or lowered by a simple command, with no manual work.

The motor assembly 2 comprises four elements, namely a rotary electric motor 4, a transmission 8, a coupling 6 providing the mechanical link between the motor 4 and the transmission 8, and an output shaft 10 connected to the transmission 8.

The four elements are situated along a transmission axis X-X. As indicated by arrow F, the torque delivered by the electric motor 4 is transmitted in the direction of the transmission axis X-X toward the output shaft 10 while passing through the transmission 8. The electric motor 4 is therefore situated at an upstream end 12 of the motor assembly 2. The output shaft 10 is situated at a downstream end 14 of the motor assembly 2. The transmission axis X-X is also the rotation axis of the output shaft 10.

The coupling 6 is inserted between the rotary motor 4 and the transmission 8 and ensures the proper torque take-up between the rotary motor 4 and the transmission 8.

The transmission 8 is preferably a reducing gear. The reducing gear 8 is connected by its first motor-side end 7 through the coupling 6 to the electric motor 4, and by its second output-side end 9 to the output shaft 10. The reducing gear 8 is used to react and adapt the torque delivered by the rotary motor 4. More specifically, it reduces the rotation speed delivered by the electric motor 4 to a rotation speed adapted to maneuvering window blinds. Consequently, the motor assembly 2 can also be described as a gear motor. The reducing gear 8 is preferably and epicyclic reducing gear.

The reducing gear 8 comprises an enclosure 15 that houses its components. A cover 50, preferably annular, is situated at the second end 9 of the reducing gear 8. The cover 50 is attached on the enclosure 8. The cover 50 surrounds the output shaft 10.

The first end 7 of the reducing gear 8 is provided with elastic tabs 17 for fastening to the coupling 6.

We will now examine the output shaft 10. The latter is shown on a larger scale in FIGS. 2 and 3.

The output shaft 10 is preferably made by injection molding. In this case, its shapes are dictated by constraints related to its manufacturing method. This in particular involves avoiding masses of material or thicknesses greater than others that are detrimental to the appearance and mechanical strength of the output shaft 10. In particular, during the molding method, the formation of air bubbles risks making the output shaft 10 more fragile and harming its outside appearance (deformations, cracks, etc.). As a result, the thicknesses are chosen to be substantially constant and reinforcing walls forming spacers are kept to optimize the mechanical strength. The inner holes are made by pins placed before the injection and removed during stripping.

The output shaft 10 has a generally cylindrical shape, and is preferably in one piece. It has a first axial end 11 that, during operation, is close to the rotary motor 4, and a second axial end 13 that, during operation, is far away from the rotary motor 4. It has two juxtaposed segments, i.e., a torque-reacting base 16 and a driving head 18.

In the assembled state of the reducing gear 2, the torque-reacting base 16 is inserted into the reducing gear 8 to react the rotation torque thereof. The driving head 18 then protrudes from the reducing gear 8.

The base 16 comprises, along the axis X-X, three segments, i.e., a gear section 20, followed by a stop section 22, followed by a retaining section 24. In the assembled state of the gear motor 2, said gear section 20 meshes with the reducing gear 8. The gear section 20 has two extensions 26. They are situated on either side of the axis X-X. They define a central hollow 28 between them. The latter may optionally serve as mistake-proofing means. The gear section 20 allows the output shaft to be engaged with the output of the reducing gear 8. In particular, the gear section 20 is directly, or indirectly, engaged with the planet carrier of the last stage of the reducing gear. The two extensions 26 extend from a shared base 30. The base 30 is in the shape of a disc have an edge 32. This base 30 serves as a support for the extensions 26. Four recesses 34 are formed in the edge 32 of the base 30. The recesses 34 are distributed regularly on the perimeter of the base 30. Each recess 34 has a section corresponding to a circular sector preferably describing an angle of about 90°. This makes it possible to avoid accumulations of material during injection molding, while retaining mechanical reinforcements between the recesses 34.

The stop section 22 assumes the form of a disc. This disc 22 has a diameter D that is larger than the diameter of the rest of the output shaft 10. Thus, the disc 22 comprises a periphery 36 that protrudes radially relative to the rest of the output shaft 10. This disc 22 serves as a bearing with the cover 50 of the reducing gear 8. The disc 22 optionally comprises planar areas 37 at the stripping lines, to avoid closing a rounded part on a rounded part, which is often a source of burrs. The presence of planar areas 37 thus makes it possible to simplify manufacturing tools while ensuring the quality of the produced output shaft 10.

The retaining section 24 comprises four radial partitions 38. These partitions 38 are regularly angularly spaced apart from one another along the circumference of the retaining section 24, preferably by an angle of 90°. The radial partitions 38 extend axially between said stop section 22 and the driving head 18. The radial partitions 38 define recesses 40 between them. Each recess 40 has a section corresponding to a circular sector preferably describing an angle of about 90°. This makes it possible to avoid accumulations of material during injection molding of the output shaft 10, while retaining mechanical reinforcements between the recesses 40. The retaining section 24 is in turn closed by the cover 50 of the reducing gear 8.

The retaining section 24 makes it possible to connect the base 16 and the driving head 18. It makes it possible to house the cover 50 closing the enclosure 15 of the reducing gear 8. The cover 50 bears on one end of the enclosure 15 of the reducing gear 8 and on the surface of the disc 22 turned outward (cf. FIG. 6).

The driving head 18 comprises a first socket 42 and a second socket 44. The first socket 42 is able to receive a drive member of a rolling shaft, in particular of a rolling tube of a roller blind, in particular, a driving wheel 45 (cf. FIGS. 6 and 7).

The first socket 42 has a globally cylindrical shape, so as to be able to receive the driving wheel 45 on its outer perimeter. The first socket 42 comprises, over a first cylinder 48, several edges 46, preferably four, forming, on their surface facing outward, a bearing surface for the driving wheel 45. The edges 46 are regularly distributed along the perimeter of the driving head 18. These edges 46 are also able to immobilize the driving wheel 45 in the axial direction. To that end, each edge 46 is separated in its longitudinal direction by a depression 52 having a bottom 54.

Figure 6:
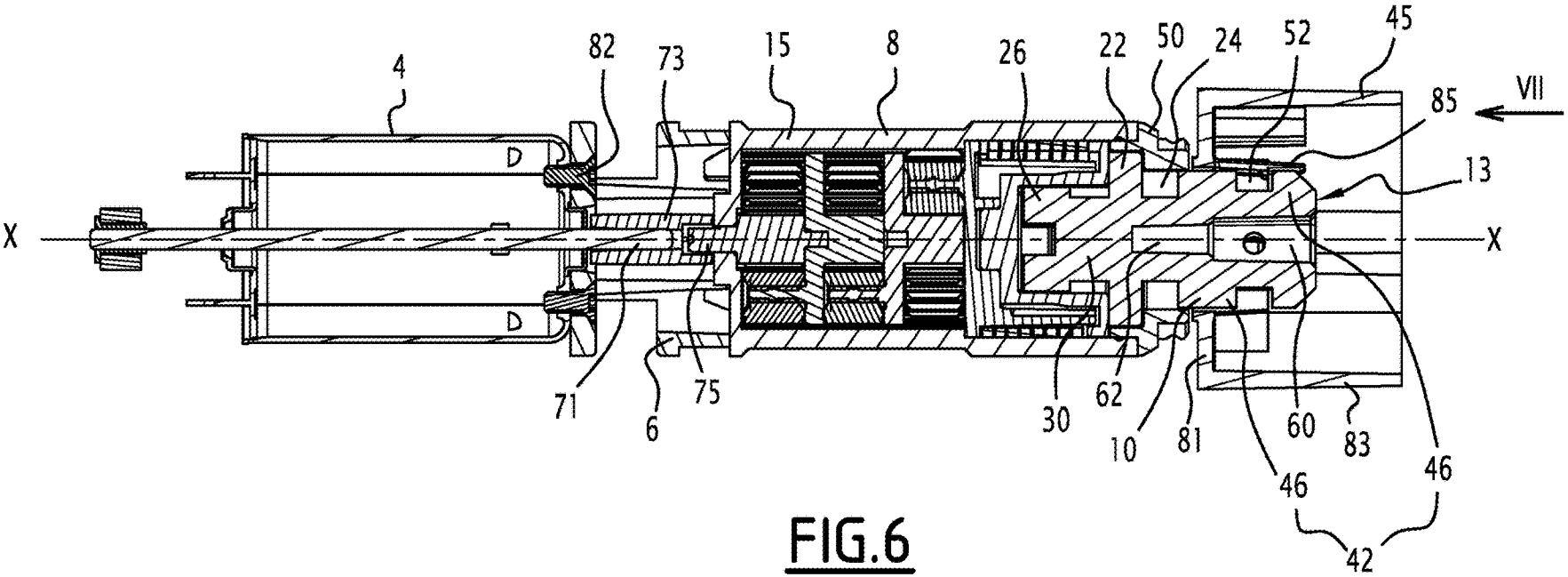
FIG. 6 is a longitudinal sectional view of the motor assembly of FIG. 1, with an attached driving wheel.

The edges 46 extend from the second end 13 of the output shaft 10 to the cover 50 of the reducing gear 8 (cf. FIG. 6). The layout of the edges 46 on a cylindrical surface makes it possible to limit the quantity of material to be provided to create the first cylindrical engagement 42 serving to support the driving wheel 45.

The second socket 44 is arranged in the second end 13 of the output shaft 10. The second socket 44 is part of a hole 58 (cf. FIG. 3) for receiving a rolling shaft end of a non-roller blind, such as a venetian blind or a pleated shade. For such a so-called "non-roller" blind, the fabric or the slats forming the solar protection screen does not roll around itself. Conversely, laces or strings are rolled on the rolling shaft to raise the load bar situated at the lower end of the blind.

The receiving hole 58 extends axially along an axis O-O that is combined with the rotation axis X-X. It is preferably a blind hole emerging at the second axial end 13.

The receiving hole 58 comprises, from the outside toward the inside, a first segment 60 in the form of a cavity, preferably with a polygonal cross-section, and in particular a rectangular cross-section, followed by a second segment 62, the second segment 62 being narrower than the first segment 60. The second segment 62 is preferably frusto-conical and therefore preferably has a circular cross-section.

The first segment 60 makes up the second socket 44.

Figure 2:
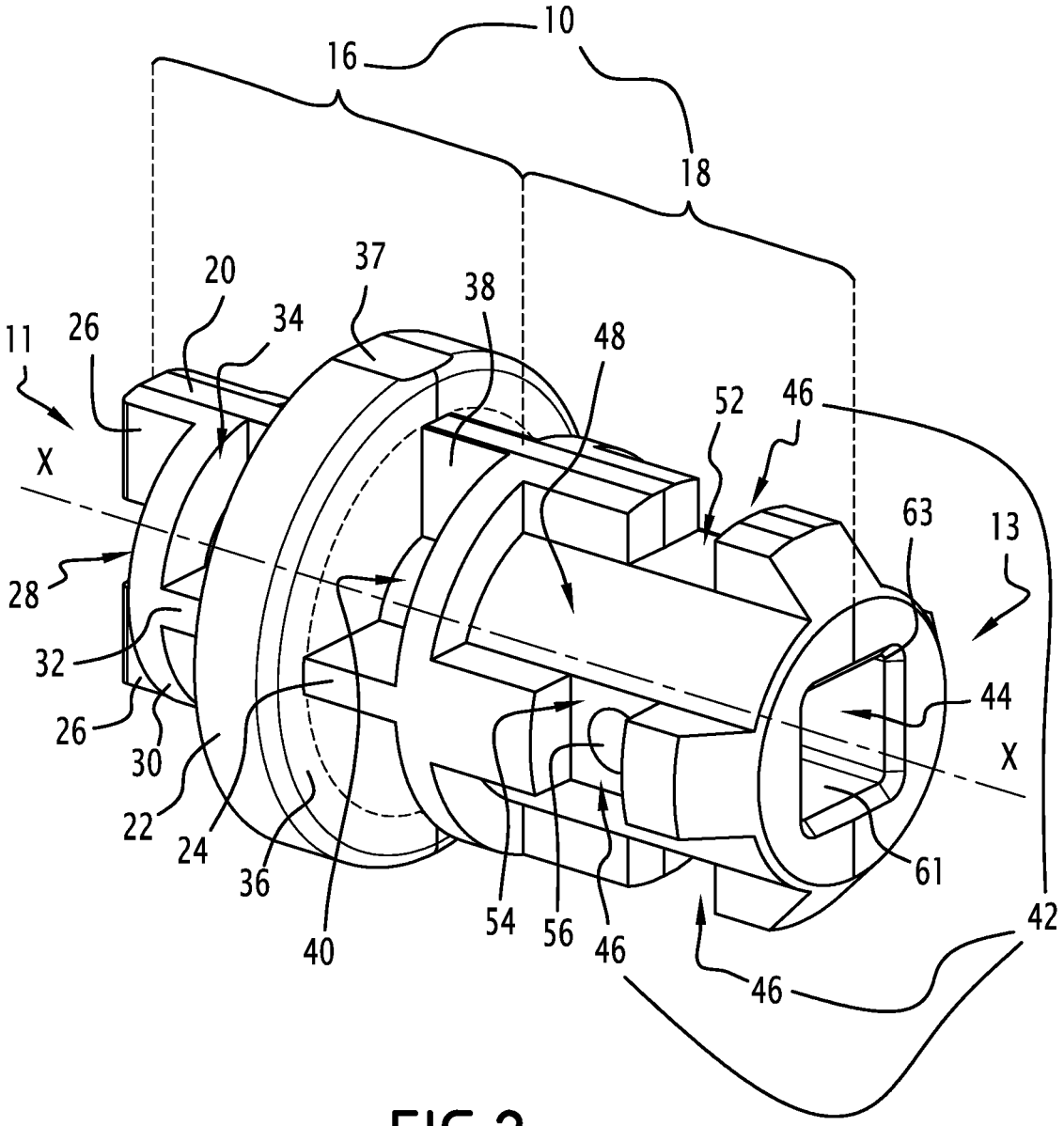
FIG. 2 is a perspective view of the output shaft of the motor assembly of FIG. 1.
Figure 3:
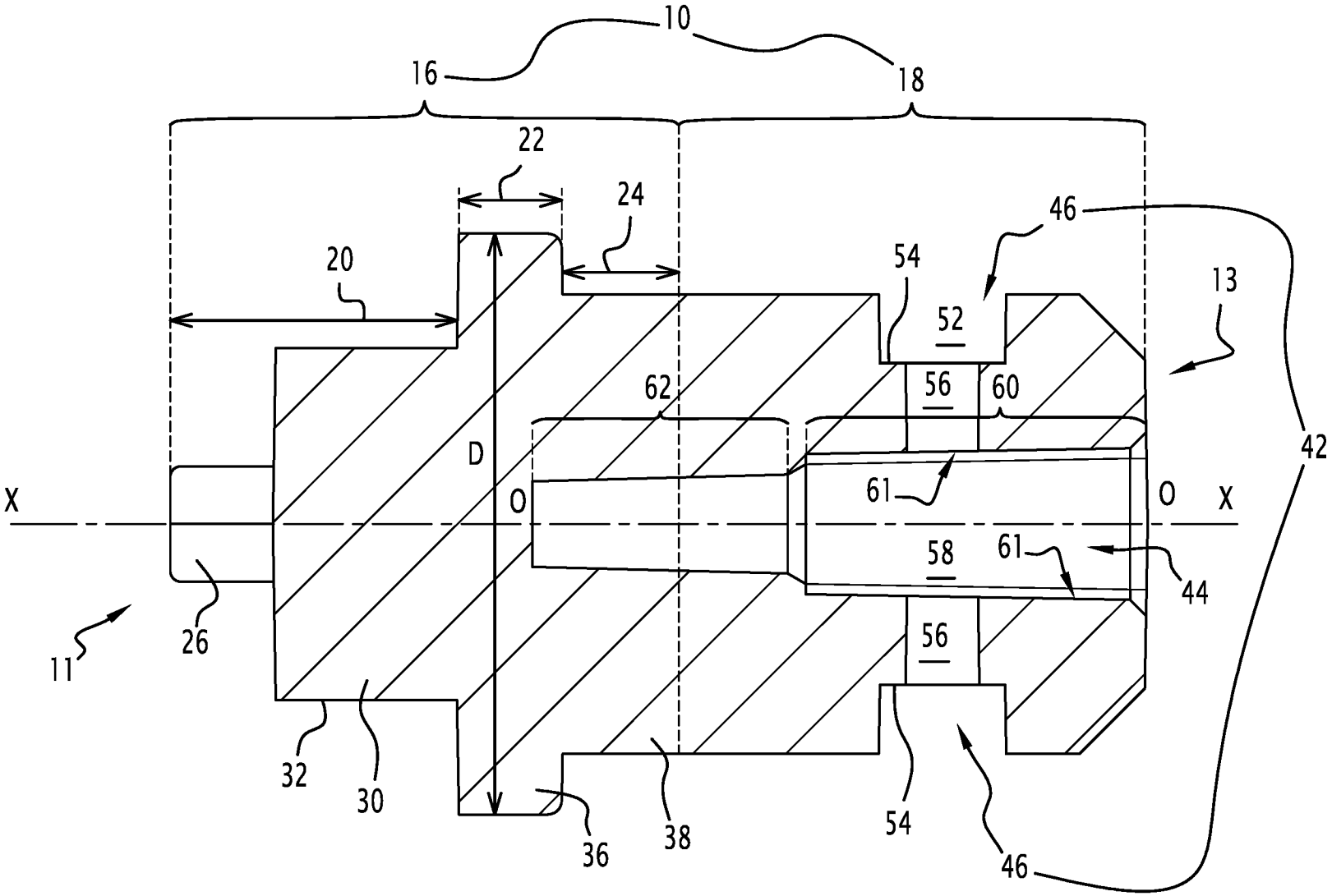
FIG. 3 is a longitudinal sectional view of the output shaft of FIG. 2.

The cavity 60 has several, for example four, inner faces 61 connected to one another by several, for example four, apices 63 (cf. FIGS. 2 and 3).

It will be noted that the receiving hole 58 axially traverses the entire driving head 18 and ends within the base 16. More specifically, the first segment 60 extends only within the driving head 18. The second frustoconical segment 62 axially straddles the driving head 18 and the base 16.

Furthermore, the driving head 18 is provided with two radial holes 56, which are positioned at some of the depressions 52 of the edges 46. Preferably, two depressions 52 situated in opposition are each provided with a radial hole 56 (cf. FIG. 3) in the bottom 54 of these depressions. It will also be noted that the radial holes 56 emerge in the receiving hole 58.

The radial holes 56 are able to receive axial fastening screws of the rolling shaft of a non-roller blind.

Preferably, the edges 46 are aligned with the faces 61 of the first segment 60. Alternatively, they could be aligned with the apices 63 of the first segment 60. The radial holes 56 would then be formed in the driving head 18 between two edges 46 through the cylinder 48.

Figure 4:
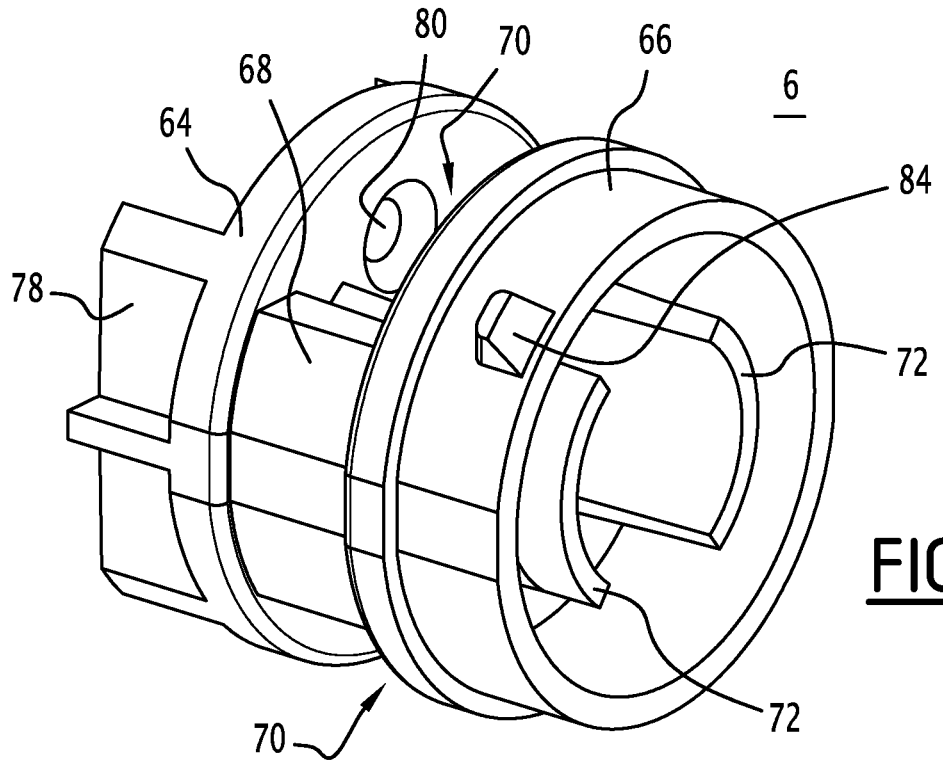
FIG. 4 is a perspective view of the coupling of the motor assembly of FIG. 1.
Figure 5:
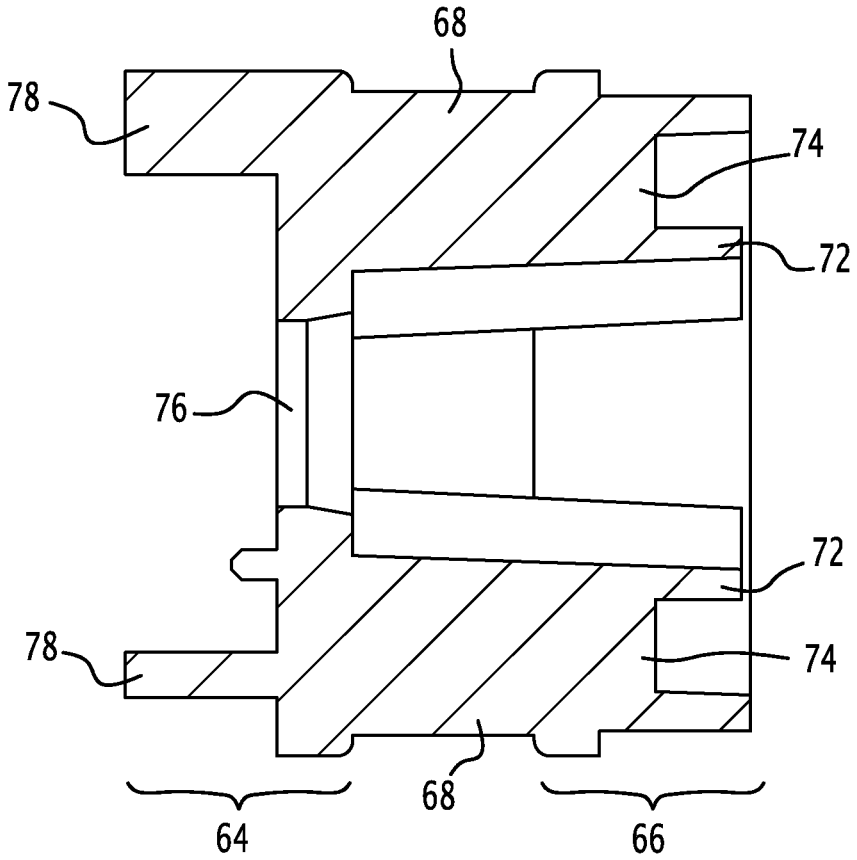
FIG. 5 is a longitudinal sectional view of the coupling of FIG. 4.

We will now examine the coupling 6. The latter is shown on a larger scale in FIGS. 4 and 5.

The coupling 6 is preferably made by injection molding. In this case, its shapes are dictated by constraints related to its manufacturing method. This in particular involves avoiding masses of material or thicknesses greater than others that are detrimental to the appearance and mechanical strength of the coupling 6. In particular, during the molding method, the formation of air bubbles risks making the coupling 6 more fragile and harming its outside appearance (deformations, cracks, etc.). As a result, the thicknesses are chosen to be substantially constant and reinforcing walls forming spacers are kept to optimize the mechanical strength. The inner holes are made by pins placed before the injection and removed during stripping.

The coupling 6 includes a first ring 64 on the motor side and a second ring 66 on the transmission side that are axially offset relative to one another and preferably connected to one another by two bridges 68. The two rings 64, 66 delimit two indentations 70 between them.

The coupling 6 further comprises two tongues 72 extending axially across from one another. The tongues 72 protrude from the first ring 64 and are surrounded by the second ring 66. Each tongue 72 is radially connected to the inside of the second ring 66 by a wall 74.

The center of first ring 64 is traversed by a through hole 76. The through hole 76 is bordered by the two tongues 72. The first ring 64 further has two planar flanks 78 for connecting to the electric motor 4. It is also provided with one or several holes 80 able to accommodate a fastening device, such as a screw 82 (cf. FIG. 1), at the electric motor 4.

In practice, the coupling 6 is mounted on the electric motor 4, for example using two screws passing through the holes 80 and plugging into a casing of the electric motor 4. The holes 80 are accessible by the transmission-side end of the coupling 6, between the tongues 72.

The second ring 66 is provided on its outer face with one or several studs 84 for fastening to the reducing gear 8. The studs 84 allow the snapping of the elastic tabs 17 of the reducing gear 8 on the outer face of the second ring 66.

Each stud 84 in particular comprises several surfaces inclined such that the snapping of the elastic tabs 17 of the reducing gear 8 can be done axially directly when the elastic tabs 17 and the studs 84 are aligned or via a rotational movement of the enclosure 15 of the reducing gear 8 relative to the second ring 66.

FIG. 6 shows the details of the kinematic chain between the electric motor 4, the reducing gear 8 and the output shaft 10.

The motor 4 comprises a motor shaft 71. This motor shaft 71 is in turn provided with a connecting piece 73, the inner section of which is preferably half moon-shaped (circular inner shape provided with a flattening). This shape cooperates with a half-moon shape of an input shaft 75 of the reducing gear 8. To assemble the reducing gear 8 on the coupling 6, it is necessary to match, blind, these two half moon-shaped parts.

Figure 7:
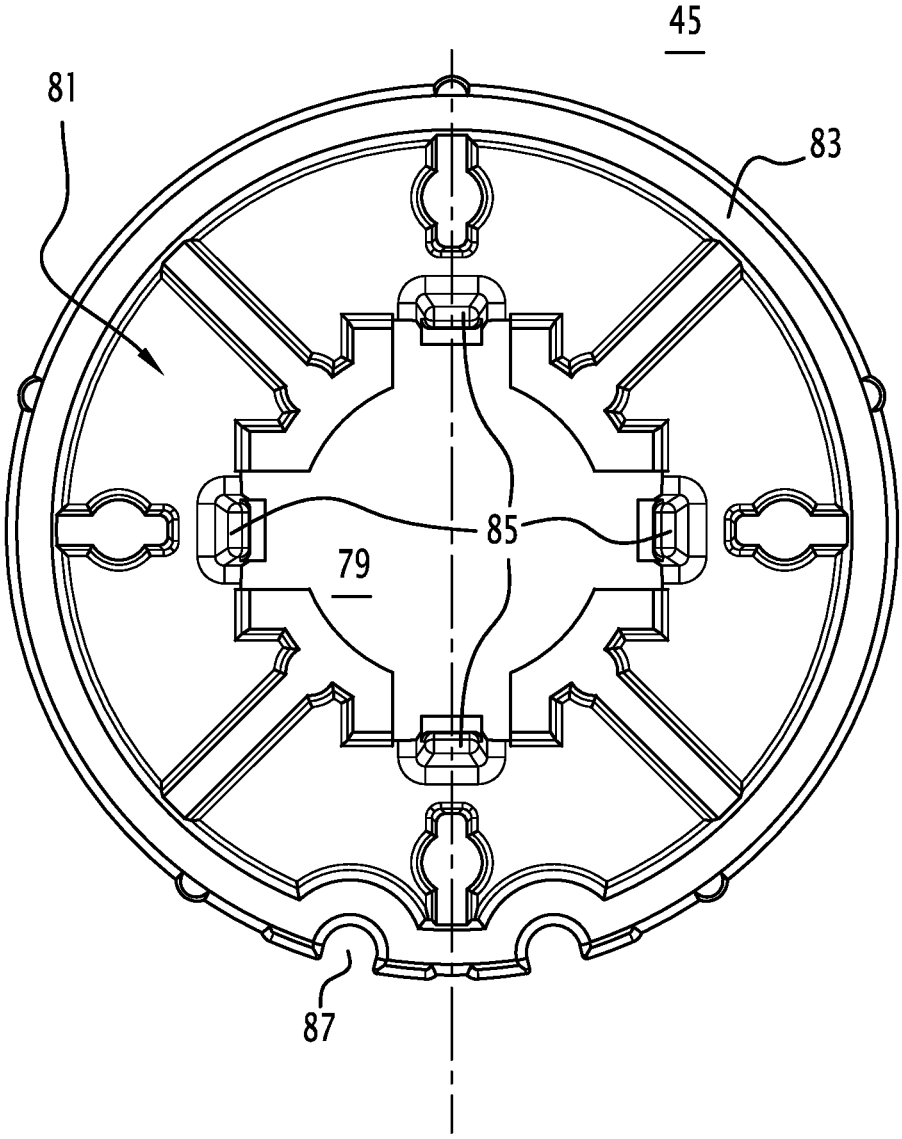
FIG. 7 is a front view of the driving wheel along arrow VII of FIG. 6.

In reference to FIGS. 6 and 7, we will now describe the driving wheel 45 and its fastening on the output shaft 10.

The driving wheel 45 includes an inner ring 81 that surrounds the rotation axis X-X. The center of the ring 81 defines a passage 79 through which the output shaft 10 can be inserted in the driving wheel.

The driving wheel 45 also includes a sleeve 83 bordering the inner ring 81.

Several, preferably four, elastic tabs 85 are arranged on the inner ring 81. The elastic tabs 85 border the central passage 79. They extend in the axial direction.

The sleeve 83 is provided on its outer face with grooves 87 for fastening to a rolling shaft of a roller blind.

As shown in FIG. 6, in the mounted state of the driving wheel 45, the first socket 42 receives, on its outer perimeter, the inner ring 81. More specifically, the edges 46 form, on their surface facing outward, a bearing surface for the inner ring 81.

The elastic tabs 85 are snapped in the recesses 52. The cover 50 forms an axial stop for the driving wheel 45 plugged onto the output shaft 10.

If necessary, to reinforce the axial maintenance of the driving wheel 45 on the output shaft 10, the latter can be blocked by a washer, which is maintained via a screw screwed in the second end 13 of the output shaft 10. The end of this screw is then housed in the second segment 62 of the hole 58 of the output shaft 10.

To fasten the driving wheel 45 in rotation relative to a rolling shaft of the blind, edges provided on the inside of the rolling shaft are inserted into the grooves 87. The driving wheel 45 is fixed axially relative to the rolling shaft via a screw or a rivet, fastened radially through the rolling shaft.

Figure 8:
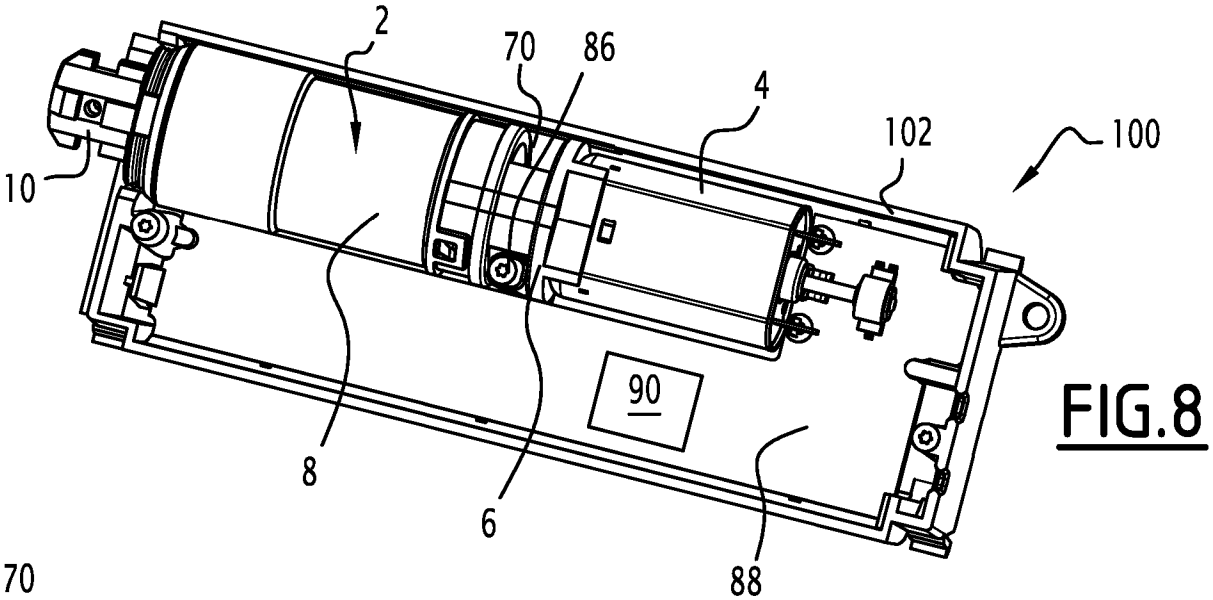
FIG. 8 is a perspective view of a motor unit for a non-roller blind comprising the motor assembly of FIG. 1, the upper half of the casing being removed.
Figure 9:
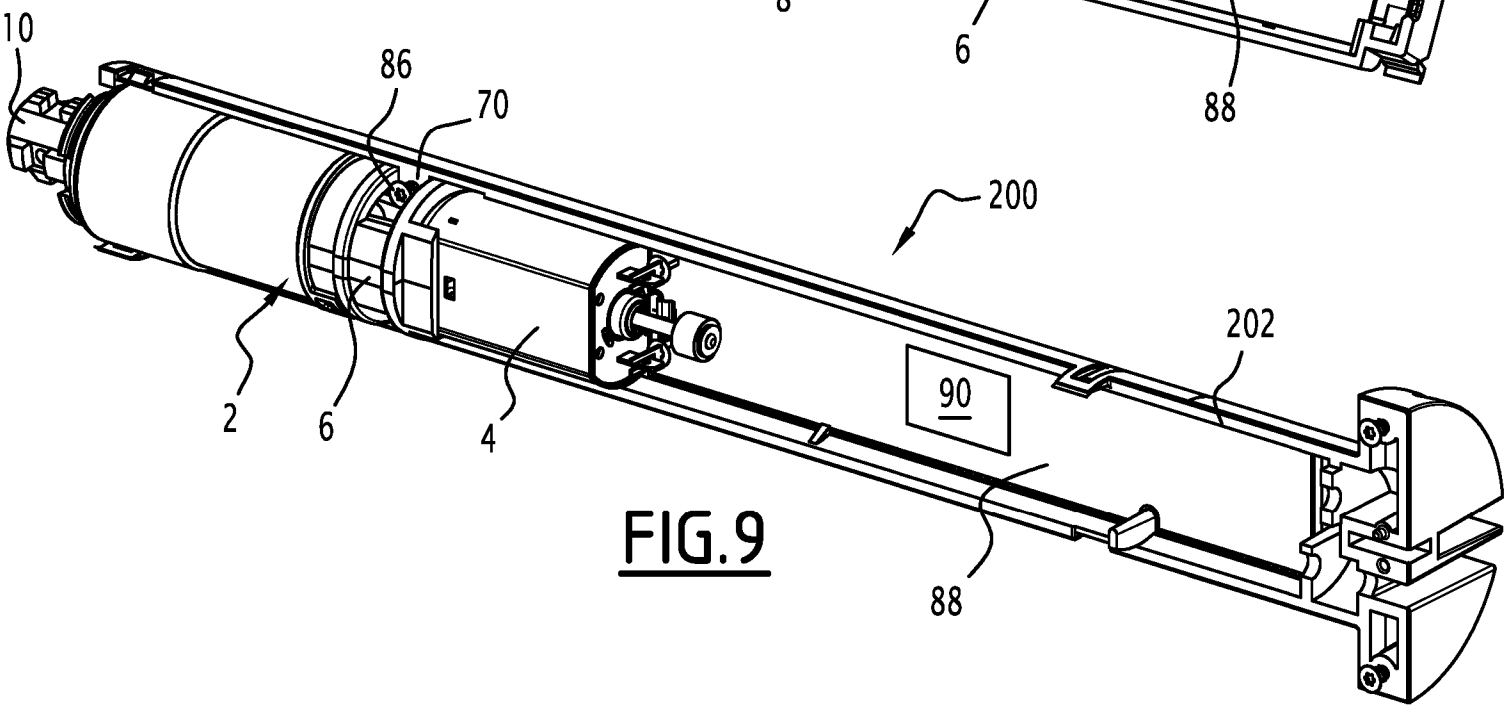
FIG. 9 is a perspective view of a motor unit for a roller blind comprising the motor assembly of FIG. 1, the upper half of the casing being removed.

FIGS. 8 and 9 show two alternatives according to the invention of a motor unit 100, 200 integrating one copy of the motor assembly 2 according to FIG. 1. The motor unit 100 according to FIG. 8 is an actuator for a non-roller blind, for example a venetian blind or a pleated shade. The motor unit 200 is a tubular motor for a roller blind.

The motors 100, 200 comprise a casing, only one 102, 202 of the two housings of which is shown. The motor assembly 2 is positioned inside the housing 102, 202 using one or several positioning rods 86. These positioning rods 86 are received in the indentations 70.

In the housing 102, 202, a printed circuit 88 is also distinguished that is provided with an electronic control unit 90 for the motor assembly 2.

The invention claimed is:

1. A motor assembly for a motor unit for rolling a blind, the assembly comprising:

a rotary electric motor; and an output shaft connected to said rotary electric motor for transmitting a torque supplied by the rotary electric motor, the output shaft comprising a first connector for securing to a rolling shaft of a roller blind, the first connector being configured to engage with a driving wheel of the rolling shaft of the roller blind, wherein the output shaft further includes a second connector, separate from the first connector, configured to engage with a rolling shaft of a non-roller blind.

2. The motor assembly according to claim 1, wherein the second connector is arranged at an end of the output shaft, opposite to the rotary electric motor.

3. The motor assembly according to claim 1, wherein the second connector comprises a cavity for receiving an end of the rolling shaft of the non-roller blind.

4. The motor assembly according to claim 3, wherein an axis of the cavity is superimposed on a rotation axis of the output shaft.

5. The motor assembly according to claim 3, wherein the cavity is a first segment of a hole, the hole comprising, from an outside of the cavity toward an inside of the cavity, said first segment followed by a second segment, the second segment being narrower than the first segment.

6. The motor assembly according to claim 5, wherein the second segment is frustoconical.

7. The motor assembly of claim 3, wherein the cavity has a polygonal section.

8. The motor assembly of claim 7, wherein the cavity has a rectangular section.

9. The motor assembly according to claim 1, wherein the first connector comprises plural axial edges on which the driving wheel can be supported and immobilized in an axial direction.

10. The motor assembly according to claim 1, further comprising:

a transmission, configured to react and adapt the torque supplied by the rotary electric motor, said transmission being connected at a first end to said rotary electric motor and at an opposite second end to said output shaft.

11. The motor assembly according to claim 10, further comprising:

a mechanical connector that couples the rotary electric motor to the transmission a manner that ensures a take-up torque between the rotary electric motor and the transmission.

12. The motor assembly according to claim 11, wherein the mechanical connector includes at least one indentation that receives a positioning element for a casing that accommodates the motor assembly.

13. The motor assembly according to claim 11, wherein the mechanical connector includes a first ring on a motor side of the mechanical connector and a second ring on a transmission side of the mechanical connector that are axially offset relative to one another.

14. The motor assembly according to claim 13, wherein the mechanical connector includes at least one indentation that receives a positioning element for a casing that accommodates the motor assembly, and wherein the first and second rings delimit the at least one indentation between them.

15. The motor assembly according to claim 13, wherein the second ring is provided with at least one stud for fastening the mechanical connector to the transmission.

16. The motor assembly according to claim 9, wherein the first connector comprises four axial edges.

17. The motor assembly according to claim 13, wherein the first ring and the second ring are connected to one another by two bridges.

18. The motor assembly according to claim 17, wherein the mechanical connector includes at least one indentation able to receive a positioning element for a casing that accommodates the motor assembly, and wherein the two rings delimit the at least one indentation therebetween.

19. The motor assembly according to claim 10, wherein the transmission is a reduction gear.

20. The motor assembly according to claim 1, wherein the first connector comprises plural axial edges configured to support and immobilize the driving wheel in an axial direction by snapping.

21. A motor unit comprising a casing including the motor assembly in accordance with claim 1 and a control unit for the motor assembly.

22. The motor unit according to claim 21, wherein the motor unit is a tubular actuator for the roller blind or an actuator for the non-roller blind.

* * * * *